US010277985B2

(12) United States Patent
Zhang et al.

(10) Patent No.: US 10,277,985 B2
(45) Date of Patent: Apr. 30, 2019

(54) SPEAKER MODULE

(71) Applicant: Goertek.Inc, Weifang, Shandong (CN)

(72) Inventors: Zhibing Zhang, Weifang (CN); Gang Chen, Weifang (CN)

(73) Assignee: Goertek.Inc, Weifang, Shandong (CN)

( * ) Notice: Subject to any disclaimer, the term of this patent is extended or adjusted under 35 U.S.C. 154(b) by 0 days.

(21) Appl. No.: 15/542,858

(22) PCT Filed: Nov. 18, 2015

(86) PCT No.: PCT/CN2015/094870
§ 371 (c)(1),
(2) Date: Jul. 11, 2017

(87) PCT Pub. No.: WO2016/155324
PCT Pub. Date: Oct. 6, 2016

(65) Prior Publication Data

US 2018/0014127 A1 Jan. 11, 2018

(30) Foreign Application Priority Data

Mar. 31, 2015 (CN) ..... 2015 1 0149804

(51) Int. Cl.
*H04R 9/06* (2006.01)
*H04R 1/02* (2006.01)
(Continued)

(52) U.S. Cl.
CPC ..... *H04R 9/06* (2013.01); *H04R 1/025* (2013.01); *H04R 7/127* (2013.01); *H04R 9/025* (2013.01);
(Continued)

(58) Field of Classification Search
CPC . H04R 9/06; H04R 9/02; H04R 9/025; H04R 9/046; H04R 7/18; H04R 7/127;
(Continued)

(56) References Cited

U.S. PATENT DOCUMENTS 8,340,336 B1 12/2012 Frerking et al.
2004/0159490 A1* 8/2004 Marlin ..... H04R 9/02 181/148
(Continued)

FOREIGN PATENT DOCUMENTS

CN 103885321 A 6/2014
CN 104768109 A 7/2015
(Continued)

OTHER PUBLICATIONS

International Search Report and English Translation dated Jan. 19, 2016 in International Patent Application No. PCT/CN2015/094870.
(Continued)

*Primary Examiner* — Leshui Zhang
(74) *Attorney, Agent, or Firm* — Michele V. Frank; Venable LLP

(57) ABSTRACT

The present invention discloses a speaker module. The speaker module comprises an inner cavity defined by a shell, and a first induction coil. A single speaker piece is provided in the inner cavity of the shell, the first induction coil is configured to be electrically connected with a terminal device, and a second induction coil, which corresponds to the first induction coil and is configured to be electrically connected with a voice coil in the single speaker piece, is also provided on the shell. According to the speaker module, an output end of a complete machine and the voice coil are conducted through the first induction coil and the second induction coil; and by the adoption of such a structure, the space of the module can be greatly saved, and a lighter and thinner complete machine can be developed. In addition, the problems, such as poor performance due to the change of the resistance value in a traditional electro-acoustic connection way, can be solved. By the adoption of the structure, the first induction coil is allowed to be provided outside the inner cavity, the shell can be sealed at a time, wiring from the
(Continued)

outside to the inside is not needed any more. In this way, secondary sealing of a lead position is avoided, production and transportation of the speaker module are greatly simplified, and assembly between the speaker module and the terminal device is also greatly simplified.

7 Claims, 3 Drawing Sheets

(51) Int. Cl.
*H04R 7/12* (2006.01)
*H04R 9/02* (2006.01)
*H04R 31/00* (2006.01)
*H04R 9/04* (2006.01)

(52) U.S. Cl.
CPC ..... *H04R 9/045* (2013.01); *H04R 9/046* (2013.01); *H04R 31/006* (2013.01); *H04R 2499/11* (2013.01)

(58) Field of Classification Search
CPC ..... H04R 1/025; H04R 1/2826; H04R 1/021; H04R 1/2888; H04R 1/2857; H04R 1/2842; H04R 1/02; H04R 2499/11; H04R 15/00; H04R 3/00; H04R 2209/00
USPC ... 381/86, 87, 332, 333, 334, 111, 116, 117, 381/345, 346, 351, 353, 354, 162, 164, 381/165, 166, 167, 370, 371, 372, 373, 381/374, 383, 384, 385, 386, 388, 389, 381/400, 401, 402, 406, 408, 409, 410; 181/202
See application file for complete search history.

(56) References Cited

U.S. PATENT DOCUMENTS

2005/0031118 A1* 2/2005 Cochran ..... H04M 1/03 379/443
2006/0018498 A1* 1/2006 Hulskemper ..... H04M 1/0254 381/331
2013/0170683 A1* 7/2013 Mei ..... H04R 11/02 381/334

FOREIGN PATENT DOCUMENTS

CN 204442659 U 7/2015
JP 2002112388 A * 4/2002

OTHER PUBLICATIONS

Written Opinion dated Jan. 19, 2016 in International Patent Application No. PCT/CN2015/094870.

* cited by examiner

SPEAKER MODULE

CROSS REFERENCE TO RELATED APPLICATIONS

This application is a national stage application, filed under 35 U.S.C. § 371, of International Application No. PCT/CN2015/094870, filed Nov. 18, 2015, which claims priority to Chinese Application No. 201510149804.2 filed Mar. 31, 2015, the contents of all of which as are hereby incorporated by reference in their entirety.

BACKGROUND

The present invention relates to the field of sounding devices, and more particularly, to a speaker module.

A speaker as an important acoustic component in an electronic device is a transducer for converting an electrical signal into an acoustic signal. The existing speaker module comprises a shell, and a vibrating system and a magnetic system provided inside the shell. The vibrating system comprises a vibrating diaphragm and a voice coil provided on the vibrating diaphragm and used for driving the vibrating diaphragm to make a sound. The voice coil is connected with the system using a lead, to achieve the circuit connectivity. In the prior art, the connection between the system and the voice coil is achieved mainly in manners of an FPCB board, a lead, an elastic sheet, etc., and these connection manners occupy a large module space and are complex in process, resulting in low reliability and a low yield of the module. And, in order to reduce the distance between the voice coil and the system, a PCB board of the system will be generally provided inside the module, which also greatly occupies the module space.

BRIEF SUMMARY

An objective of the present invention is to provide a novel technical solution of a speaker module.

According to the first aspect of the present invention, there is provided a speaker module, comprising comprises an inner cavity defined by a shell, and a first induction coil. A single speaker piece is provided in the inner cavity of the shell, the first induction coil is configured to be electrically connected with a terminal device, and a second induction coil, which corresponds to the first induction coil and is configured to be electrically connected with a voice coil in the single speaker piece, is also provided on the shell.

Preferably, the first induction coil is provided opposite to the second induction coil.

Preferably, the second induction coil is provided inside the inner cavity of the shell.

Preferably, a magnetic conductive plate is respectively provided on end surfaces, away from each other, of the first induction coil and the second induction coil.

Preferably, a magnetic conductive column or magnetic conductive liquid is provided inside a through hole of each of the first induction coil and the second induction coil.

Preferably, the shell comprises an upper shell, an intermediate shell and a lower shell that are buckled together in sequence.

Preferably, the second induction coil is located at one side, adjacent to the lower shell, of the intermediate shell, and the first induction coil is located at the other side of the intermediate shell.

Preferably, the first induction coil and the second induction coil are fixed to the intermediate shell by gluing or injection molding.

Preferably, a limiting groove for accommodating the first induction coil and the second induction coil is provided in a corresponding position of the intermediate shell.

Preferably, the limiting groove is defined by a protrusion extending from the end surface of the intermediate shell.

According to the speaker module of the present invention, an output end of a complete machine and the voice coil are conducted through the first induction coil and the second induction coil; by the adoption of such structure, space of the module can be greatly saved, and a lighter and thinner complete machine can be developed. In addition, the problems, such as poor performance due to the change of the resistance value in a traditional electro-acoustic connection way, can be solved. By the adoption of the structure of the first induction coil and the second induction coil, the first induction coil is allowed to be provided outside the inner cavity, the shell can be sealed at a time, wiring from the outside to the inside is not needed any more. In this way, secondary sealing of a lead position is avoided, production and transportation of the speaker module are greatly simplified, and assembly between the speaker module and the terminal device is also greatly simplified.

The inventor of the preset invention finds that, in the prior art, the connection between the terminal device and the voice coil is achieved mainly in manners of FPCB board, lead, spring leaf, etc., and these connection manners occupy a large module space and are complex in process, resulting in low reliability and yield of the module. Therefore, the technical task to be achieved by the present invention or the technical problem to be solved by the present invention is an unintentional or unanticipated one of those skilled in the art, and accordingly, the present invention is a novel technical solution.

Other features and advantages of the present invention will become apparent from the following detailed description of exemplary embodiments of the present invention with reference to the accompanying drawings.

BRIEF DESCRIPTION OF THE FIGURES

The accompanying drawings, which are incorporated in and constitute a part of the description, illustrate embodiments of the present invention and, together with the description thereof, serve to explain the principles of the present invention.

Figure 1:
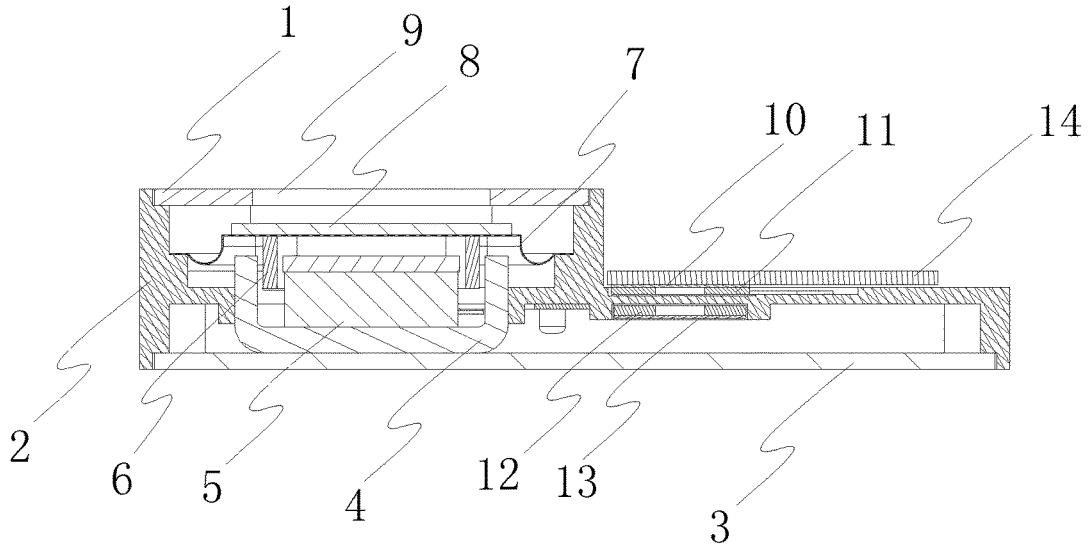
FIG. 1 is a cross-sectional view of the speaker module of the present invention.

The reference signs represent the following components: 1—upper shell; 2—intermediate shell; 3—lower shell; 4—basin stand; 5—magnet; 6—voice coil; 7—vibrating diaphragm; 8—dome; 9—sound aperture; 10—magnetic conductive plate; 11—first induction coil; 12—second induction coil; 13—magnetic conductive plate; 14—terminal device; 15—positioning column; 16—limiting groove.

DETAILED DESCRIPTION OF VARIOUS EMBODIMENTS

Various exemplary embodiments of the present invention will now be described in detail with reference to the accompanying drawings. It should be noted that the relative arrangement, numerical expressions and numerical values of the components and steps set forth in these examples do not limit the scope of the invention unless otherwise specified.

The following description of at least one exemplary embodiment is in fact merely illustrative and is in no way intended as a limitation to the present invention and its application or use.

Techniques, methods, and apparatus known to those of ordinary skill in the relevant art may not be discussed in detail but where appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, and there is no need for further discussion in the subsequent accompanying drawings.

Figure 2:
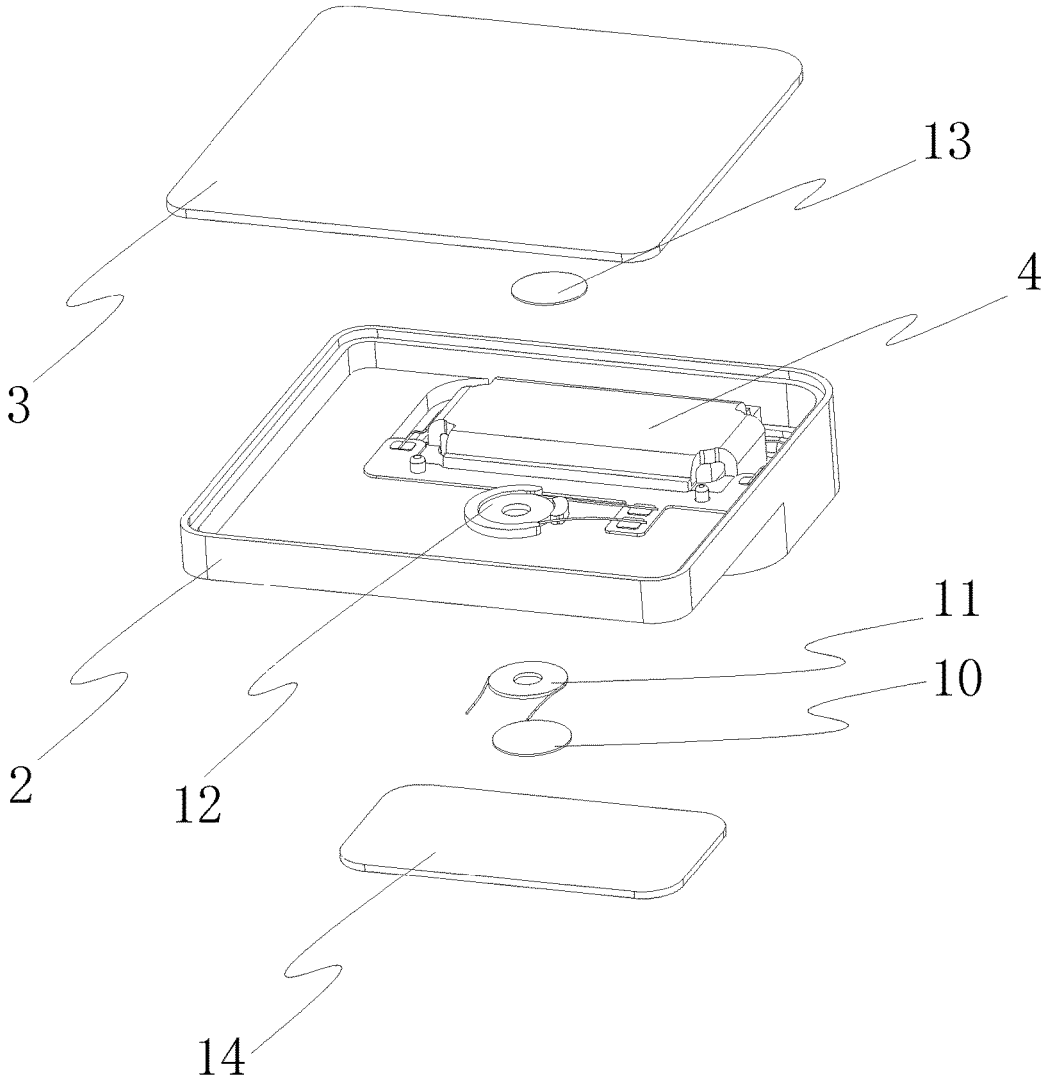
FIG. 2 is a schematic view of a partially exploded structure of the speaker module of the present invention.

Referring to FIG. 1 and FIG. 2, the present invention provides a speaker module, comprising an inner cavity defined by a shell and a single speaker piece mounted in the inner cavity of the shell, wherein the single speaker piece comprises a magnetic system and a vibrating system. The magnetic system comprises a basin frame 4, a magnet 5, a washer and the like located in the inner cavity of the shell, wherein the magnet 5 is located in the basin frame 4 and has a magnetic gap with a side wall of the basin frame 4. The vibrating system comprises a vibrating diaphragm 7 fixed inside the inner cavity of the shell and a voice coil 6 for driving the vibrating diaphragm 7 to make a sound, wherein the voice coil 6 is fixed to the vibrating diaphragm 7 and suspended in the magnetic gap between the magnet 5 and the side wall of the basin frame 4; the vibrating diaphragm 7 separates the inner cavity of the shell into a front sound cavity and a rear sound cavity; a sound aperture 9 is provided in a position where the front sound cavity is located, on the shell so that the sound flows out; and the rear sound cavity is an enclosed structure, which is communicated with the outside merely via a damping hole. A dome 8 and the like are also provided at the center of the vibrating diaphragm 7.

After the voice coil 6 is energized, the voice coil 6 will vibrate under the action of the magnetic system, and at the same time, the voice coil 6 will vibrate together with the vibrating diaphragm 7 to realize the sounding of the vibrating diaphragm 7.

The speaker module of the present invention further comprises a first induction coil 11 configured to be electrically connected with a terminal device 14, a second induction coil 12 which corresponds to the first induction coil 11 and is configured to be electrically connected with the voice coil 6 in the single speaker piece being also provided on the shell. Particularly, the first induction coil 11 may be fixed to the shell or may be fixed to the terminal device 14. The terminal device 14 may be, for example, a PCB board of a device such as a mobile phone or a tablet computer. The first induction coil 11 is electrically connected with a control circuit board which is located in the terminal device 14 and used for controlling the speaker to make a sound. The first induction coil 11 may be fixed to an outer wall of the shell or may be fixed to an inner wall of the shell. The second induction coil 12 is preferably fixed in the inner cavity of the shell or fixed to the inner wall of the shell. The first induction coil 11 and the second induction coil 12 are arranged correspondingly; that is, they are at least partially overlapped together. Of course, it is preferable for those skilled in the art that they are completely overlapped; i.e., the first induction coil 11 and the second induction coil 12 are parallel to each other and face each other.

According to the speaker module of the present invention, the first induction coil 11 is electrically connected with the terminal device 14, and the second induction coil 12 is electrically connected with the voice coil 6. The terminal device 14 conducts a current signal of an external audio to the first induction coil 11 in an operating process, so that the first induction coil 11 generates a magnetic field which changes as the audio signal current changes; and the second induction coil 12 senses the changed magnetic field; that is, when the magnetic flux flowing through a closed circuit changes, a correspondingly changing current will be generated. The changing current is conducted to the voice coil 6 so as to drive the voice coil 6 to vibrate and finally realize the sounding of the single speaker piece.

According to the speaker module of the present invention, an output end of a complete machine and the voice coil are conducted through the first induction coil and the second induction coil; and by the adoption of such structure, space of the module can be greatly saved, and a lighter and thinner complete machine can be developed. In addition, the problems, such as poor performance due to the change of the resistance value in a traditional electro-acoustic connection way, can be solved. By the adoption of the structure of the first induction coil and the second induction coil, the first induction coil is allowed to be provided outside the inner cavity, the shell can be sealed at a time, wiring from the outside to the inside is not needed any more. In this way, secondary sealing of a lead position is avoided, production and transportation of the speaker module are greatly simplified, and assembly between the speaker module and the terminal device is also greatly simplified.

Figure 3:
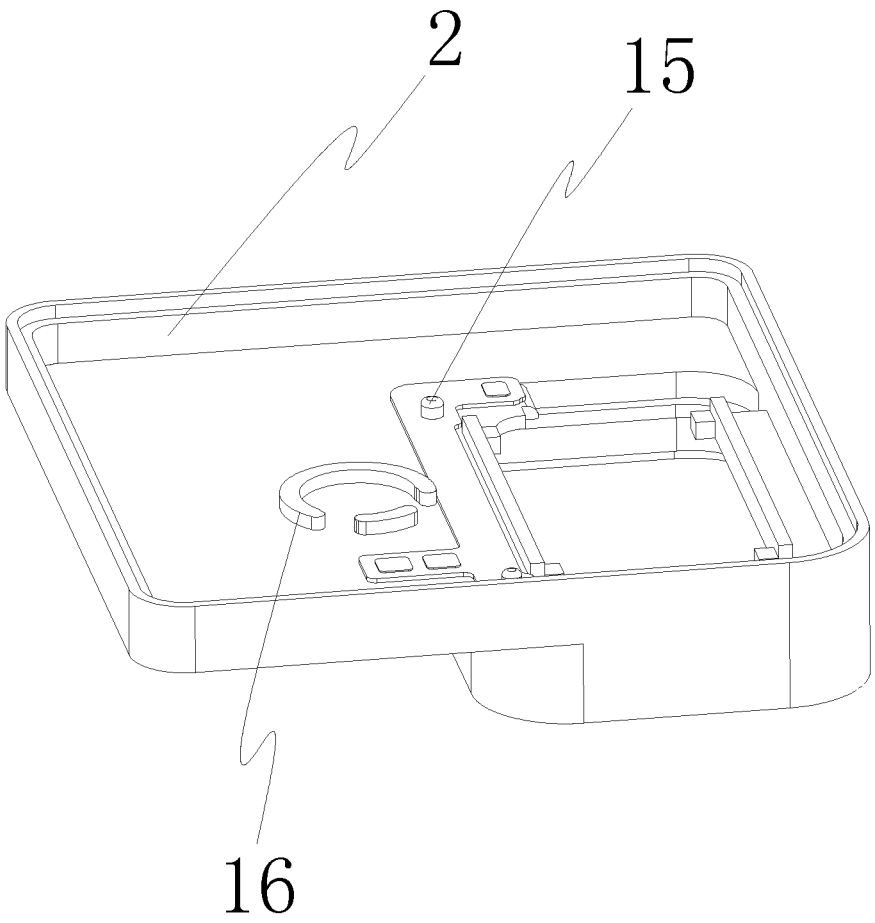
FIG. 3 is a schematic structural view of the intermediate shell of the present invention.

In a specific embodiment of the present invention, the shell comprises an upper shell 1, an intermediate shell 2 and a lower shell 3 which are buckled together in sequence, wherein the upper shell 1 is buckled to an upper opening of the intermediate shell 2; the lower shell 3 is buckled to a lower opening of the intermediate shell 2; and the inner diameters of the two openings of the intermediate shell 2 are different, so that a step portion for the placement of the first induction coil 11 and the second induction coil 12 is formed on the intermediate shell 2. Referring to FIG. 3, an FPCB board of the voice coil 6 can also be fixed to the intermediate shell 2 via a positioning column 15 for connecting a lead of the voice coil 6.

The first induction coil 11 and the second induction coil 12 may be provided at both sides of the intermediate shell 2 respectively, for example, the second induction coil 12 is located at one side, adjacent to the lower shell 3, of the intermediate shell 2, and the first induction coil 11 is located at the other side of the intermediate shell 2. The first induction coil 11 and the second induction coil 12 are fixed to the intermediate shell 2 by gluing or injection molding. For example, referring to FIG. 3, a limiting groove 16 for accommodating the first induction coil 11 and the second induction coil 12 is provided in a corresponding position of the intermediate shell 2, wherein the limiting groove 16 is defined by a protrusion extending from the end surface of the intermediate shell 16. The shape of the first induction coil 11 and the second induction coil 12 may be selected according to actual needs such as circular, rectangular or oval shape or other irregular shapes.

In order to improve the magnetic flux utilization between the first induction coil 11 and the second induction coil 12, a magnetic conductive plate 10, 13 are respectively provided on end surfaces, away from each other, of the first induction coil 11 and the second induction coil 12. For example, when the first induction coil 11 and the second induction coil 12 face each other vertically, the magnetic conductive plate 10 is provided at the upper end of the first induction coil 11, and the magnetic conductive plate 13 is provided at the lower end of the second induction coil 12. By the magnetic conductive plates 10, 13, not only the magnetic flux utilization can be improved, but also the influence of the two induction coils on other devices can be avoided. In order to improve the magnetic flux utilization rate, a magnetic conductive column or magnetic conductive liquid is provided inside a through hole of each of the first induction coil 11 and the second induction coil 12.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is subject to the attached claims.

The invention claimed is:

1. A speaker module, comprising:

an inner cavity defined by a shell, wherein a single speaker piece is provided in the inner cavity of the shell;

a first induction coil that is configured to be electrically connected with a terminal device; and a second induction coil that corresponds to the first induction coil and is configured to be electrically connected with a voice coil in the single speaker piece, is also provided on the shell;

wherein the second induction coil is located on the inner side of the shell, and the first induction coil is located on the outer side of the shell, the shell comprises an upper shell, an intermediate shell for placing the first induction coil and the second induction coil and a lower shell arranged in sequence, the second induction coil being located at one side of the intermediate shell adjacent to the lower shell, and the first induction coil being located at the other side of the intermediate shell, and the first induction coil and the second induction coil are fixed to the intermediate shell by gluing or injection molding.

2. The speaker module according to claim 1, wherein the first induction coil is provided opposite to the second induction coil.

3. The speaker module according to claim 1, wherein magnetic conductive plates are respectively provided on end surfaces, away from each other, of the first induction coil and the second induction coil.

4. The speaker module according to claim 1, wherein a magnetic conductive column or magnetic conductive liquid is provided inside a through hole of each of the first induction coil and the second induction coil.

5. The speaker module according to claim 1, wherein the upper shell, the intermediate shell and the lower shell are buckled together in sequence.

6. The speaker module according to claim 1, wherein a limiting groove for accommodating the first induction coil and the second induction coil is provided in a corresponding position of the intermediate shell.

7. The speaker module according to claim 6, wherein the limiting groove is defined by a protrusion extending from an end surface of the intermediate shell.

* * * * *